United States Patent [19]

Arrigoni

[11] 4,350,985

[45] Sep. 21, 1982

[54] EYE PROTECTOR FOR TELEVISION SET ROD ANTENNA

[76] Inventor: Edward A. Arrigoni, 712 Kamuela Ave., Honolulu, Hi. 96816

[21] Appl. No.: 126,767

[22] Filed: Mar. 3, 1980

Related U.S. Application Data

[63] Continuation of Ser. No. 844,005, Oct. 20, 1977, abandoned, which is a continuation-in-part of Ser. No. 797,719, May 17, 1977, abandoned, which is a continuation-in-part of Ser. No. 776,148, Mar. 10, 1977, abandoned.

[51] Int. Cl.[3] ..... H01Q 1/24

[52] U.S. Cl. ..... 343/702

[58] Field of Search ..... 343/702, 720, 760, 805, 343/894

[56] References Cited

U.S. PATENT DOCUMENTS

| | | | |
|---|---|---|---|
| 2,582,159 | 1/1952 | Race | 343/805 |
| 2,849,712 | 8/1958 | Klancnik | 343/805 |
| 2,895,130 | 7/1959 | Klancnik | 343/805 |
| 2,983,917 | 5/1961 | Spirt | 343/805 |

*Primary Examiner*—Eli Lieberman

*Attorney, Agent, or Firm*—John L. McGannon

[57] ABSTRACT

For use on the outer end of the antenna shaft of a television set. A protector-receptor having a solid body of soft, plastic foam, yieldable or resilient material, such as polyurethane, for preventing the outer end of the antenna shaft from poking the eye when a person's head is in proximity to the antenna shaft. The body has a metallic material embedded therein to enhance television signal reception. The body has a passage extending into it from its outer periphery and is mounted in an operative position with the outer end of the antenna shaft inserted into the passage. A tubular fastener can be mounted on the portion of the antenna shaft inserted in the passage to provide a more positive coupling to the body. Several embodiments of the fastener are disclosed. The body can be spherical or of another shape. The metal material in the body can be of any shape or size and can be in any suitable position in the body.

1 Claim, 18 Drawing Figures

FIG.8
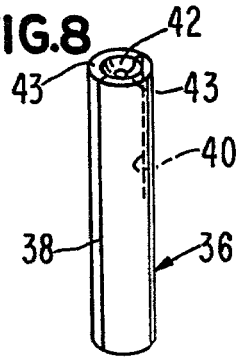
FIG.9
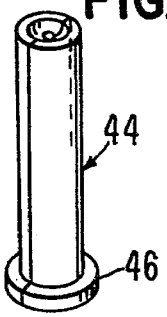
FIG.10
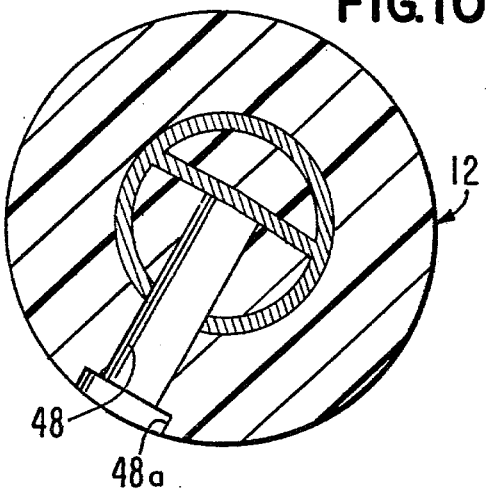
FIG.11
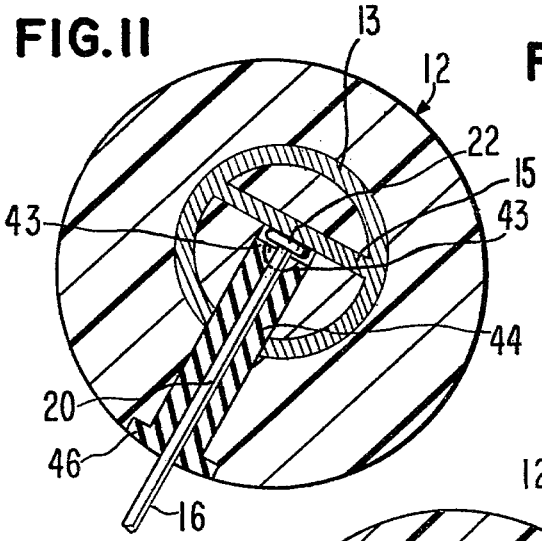
FIG.12
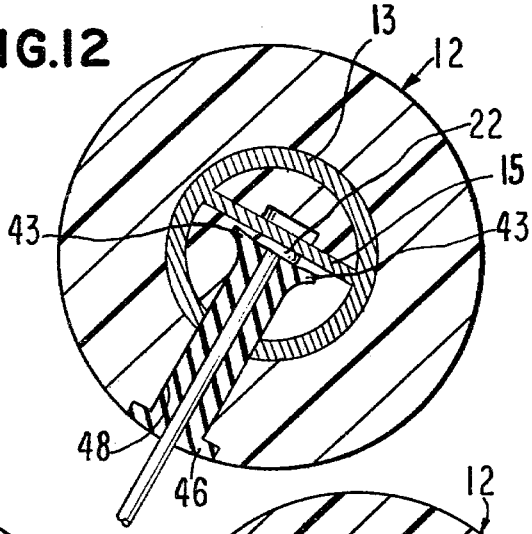
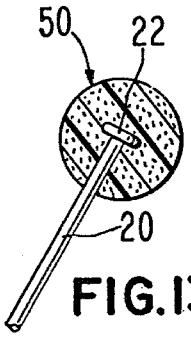
FIG.13
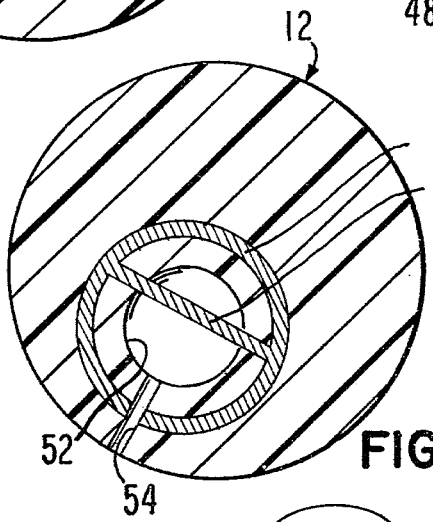
FIG.14
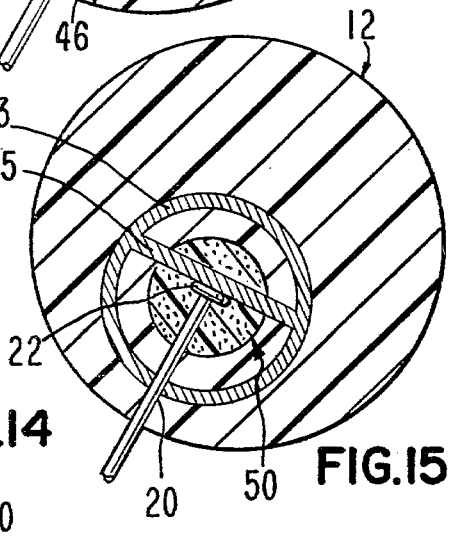
FIG.15
FIG.16
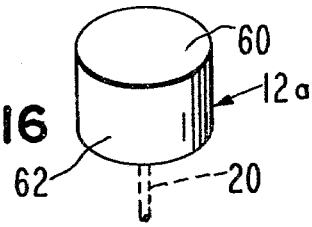

EYE PROTECTOR FOR TELEVISION SET ROD ANTENNA

This is a continuation of application Ser. No. 844,005, filed Oct. 20, 1977; the latter application being a continuation-in-part of Ser. No. 797,719, filed May 17, 1977, which is a continuation-in-part of Ser. No. 766,148, filed Mar. 10, 1977, all abandoned.

This invention relates to improvements in safety devices and television signal reception for television sets. Protection against injury to the eye by the antenna shaft of a television set and an increase in television signal reception are accentuated.

BACKGROUND OF THE INVENTION

Television antennae known as "rabbit ears" pivotally mounted on a television set often present a hazard to the eyes of an individual moving in proximity to the television set. Also, signal reception can sometimes be enhanced on the antenna shafts by the addition of tin foil or other metal which provides a greater receiving surface. These antenna shafts are usually plated and sometimes the contrast between an antenna shaft and adjacent walls or articles of furniture is not sufficient to cause a person to become aware of the presence or orientation of the antenna shaft. As a result, persons can walk directly into the antenna shaft which pokes their eyes or other facial parts. This can cause permanent damage if the injury is severe enough.

Since antenna shafts of this type are pivotally mounted on the television set itself, they are often moved into various angled positions to tune to particular television stations. They often project laterally or forwardly of the television set and in the path of movement of persons walking past or toward the television set itself. In this situation, a hazard arises and people nearby must be aware of the locations of the antenna shafts to prevent being injured by them. Furthermore, improving signal reception capabilities of the antenna shafts could reduce the necessity of positioning the antenna shafts in dangerously protruding attitudes.

Thus, a need has arisen to provide a simple device for use in protecting the facial parts, especially the eyes, from being poked by an antenna shaft on a television set and for simultaneously providing a better signal reception.

SUMMARY OF THE INVENTION

This invention satisfies the foregoing need by providing an improved protector-receptor for the outer end of a television antenna shaft to protect against injury to the eyes and simultaneously to improve signal reception. To this end, the protector-receptor includes a solid body of yieldable or resilient material, such as foam plastic, with a metal signal enhancer inside. The body has a passage extending inwardly from the outer periphery thereof. Thus the protector-receptor can be placed over the distal end of a television antenna by inserting this end into the passage sufficiently far so that the protector-receptor is retained on the antenna.

The body is of one-piece construction and can be large enough and of any color to attract the attention of a person walking by or moving near the television set. Even if an individual nearby does not see the antenna shaft, the protector-receptor will prevent permanent or other injury to the facial parts including the eye. The protector-receptor is typically of a spherical shape but it can be of any other desired shape as well. The metal enhancer inside the body can be of any size or shape and can be in any position within the body. It can be provided with a plastic liner in the passage thereof to minimize any damage to the body itself as it is placed on and taken off the antenna one or more times. Also, the protector-receptor is adapted to fit the antennas of substantially all types of television sets having "rabbit ears".

A fastener can be provided on the antenna shaft before it is inserted in the passage of the body. In one form the fastener has an expandable end which is forced laterally by the end button on the antenna shaft when the body and fastener are moved relative to the antenna shaft through a short distance. This expandable end then forms a lateral projection which juts into the body to frictionally hold it coupled to the antenna shaft.

Another form of the fastener is a small ball which fits onto the end of the antenna shaft. The inner part of the passage in the wall is spherical to receive the ball, the outer part of the passage being narrow but expandable to permit insertion of the ball in place.

The primary object of this invention is to provide a protector-receptor for the outer end of an antenna shaft of the type pivotally attached to a television set, wherein the protector-receptor comprises a body of yieldable material with the body having a metallic signal enhancer embedded therein and the body being large enough to prevent any contact of the eye with the outer end of the antenna shaft to thereby eliminate any possibility of injury to the eye when the person comes too close to the antenna shaft, yet the signal-receiving characteristics of the antenna shaft will be improved.

Another object of this invention is to provide a solid, one-piece body of foam plastic material which has a yieldable outer surface and a passage extending inwardly from its outer periphery so that it can be placed on the outer end of a pivotal antenna shaft of a television set to cover such end and prevent injury to the eye and improve television signal reception regardless of the angle at which the antenna extends from the television set.

Other objects of this invention will become apparent as the following specification progresses, reference being made to the accompanying drawing for an illustration of the invention.

IN THE DRAWINGS

Figure 2:
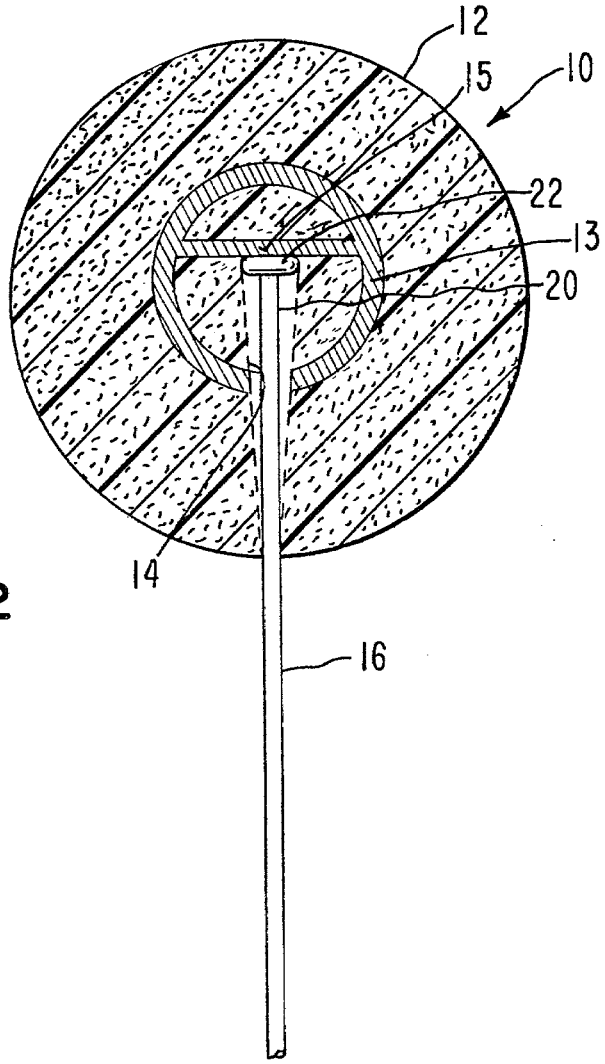
FIG. 2 is an enlarged, cross-sectional view of the protector-receptor mounted directly on the outer end of an antenna shaft with a fastener between the protector-receptor and the antenna shaft.
Figure 3A:
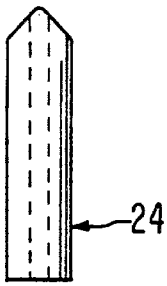
Figure 3B:
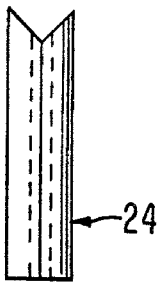
Figure 3C:
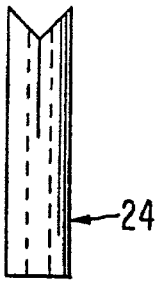
Figure 4:
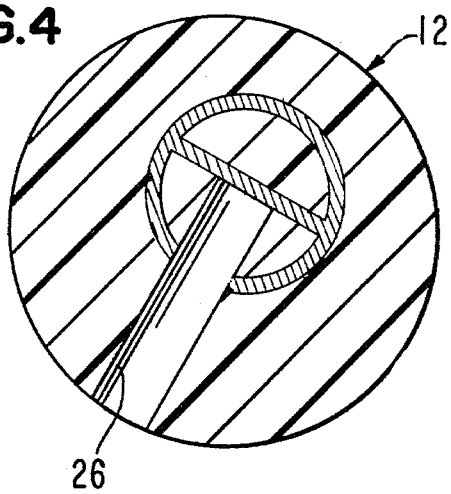
Figure 5:
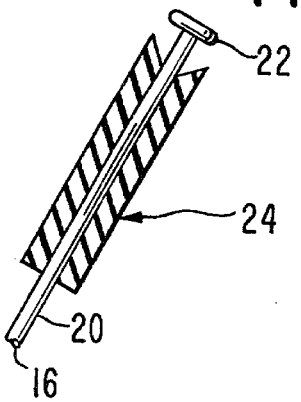
Figure 6:
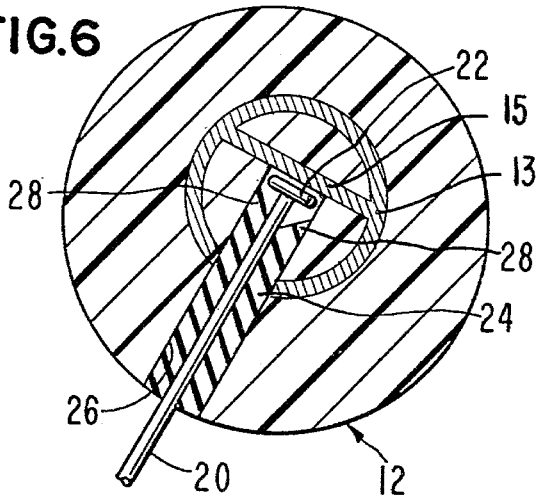
Figure 7:
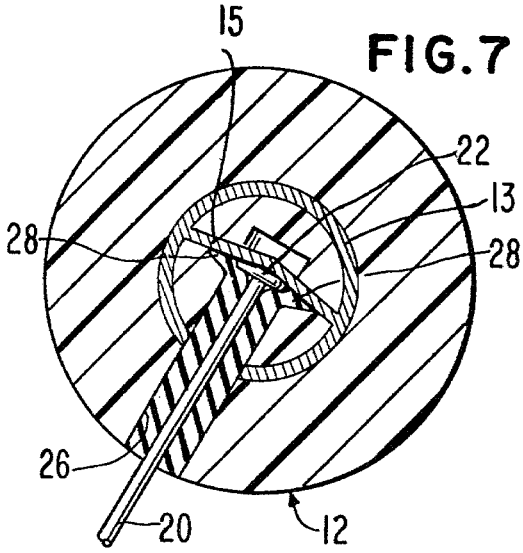

FIGS. 3*a*, 3*b* and 3*c* are side elevational views of a cylindrical fastener for releasably coupling the protector-receptor to the antenna shaft;

FIG. 4 is a view similar to FIG. 2 but showing the shape of the passage in the protector-receptor for accommodating the fastener of FIGS. 3*a*–3*c*;

FIGS. 5, 6 and 7 are views illustrating the way in which the fastener is used to couple the protector-receptor to the antenna shaft;

FIGS. 8 and 9 are views similar to FIGS. 3*a*–3*c* but showing two other types of cylindrical fasteners;

FIG. 10 is a view similar to FIG. 4 but showing the shape of the passage for the fastener of FIG. 9;

FIGS. 11 and 12 are views similar to FIGS. 6 and 7 but showing the way in which the fastener of FIG. 9 is used;

FIG. 13 is a cross-sectional view of another type of a ball-type fastener on the outer end of the antenna shaft;

FIGS. 14 and 15 are views similar to FIGS. 4–7 and 10–12 but showing the way in which the fastener of FIG. 13 is used; and FIG. 16 is a perspective view of another form of the protector-receptor showing a cylindrical shape for the same.

Figure 1:
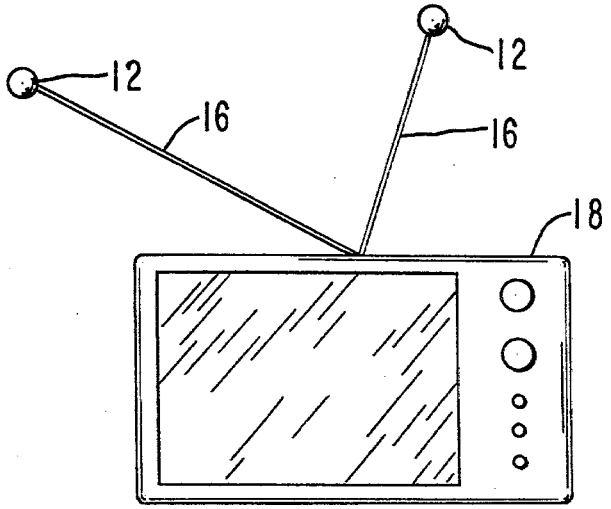
FIG. 1 is a side elevational view of a conventional television set having the protector-receptor of the present invention on the outer ends of the antenna shafts thereof.

The protector-receptor of the present invention is broadly denoted by the numeral 10 and includes a solid body 12 of plstic foam material which is soft to the touch, is spongy, and when squeezed, yields inwardly. Body 12 is shown as being spherical in FIGS. 1 and 2; however, it can be of other shapes as hereinafter described. It is formed in any suitable manner, such as by a molding process.

A metallic signal enhancer 13 is embedded in body 12 at any suiable location therein. The enhancer can be of any good electrically conducting material, such as copper, and it can be embedded in the body when the latter is formed by a molding process. For purposes of illustration, enhancer 13 is a split-ring in FIG. 2 with a crosspiece 15 for use as a brace. However, the enhancer can be of any other size and shape, such as spherical, square, L-shaped and the like.

Body 12 is provided with a passage 14 extending into it from its outer periphery. The passage is essentially a slit which is normally closed due to the resilience of the material of body 12 but which opens when the material is expanded in the vicinity of the slit. The passage can extend to the center of body 12 or beyond. As shown in FIG. 2, the slit passes through the break in the split-ring enhancer 13.

Typically, the inner end of the passage is at a location equal to one-half to three-fourths of the diameter of the body. The body has a diameter typically in the range of two to three inches but can be larger if desired. The material of the body can be of any one of a number of various types, including foam polyurethane. This material can be of any specific color by addition of a suitable dye thereto.

In use, the antenna shafts 16 of a conventional television set 18 are extended. A pair of bodies 12 are placed on the outer ends of the antenna shafts 16 by inserting the outer ends 20 of the shafts into passage 14 of respective bodies 12. A button-like projection 22 is usually secured to outer end 20 of each shaft 16 but this projection can enter passage 14 because the material of body 12 stretches sufficiently to allow for this. As shown in FIG. 2, passage 14 tapers to the diameter of the corresponding shaft 16 as the outer periphery of the body is approached. Thus, the body is retained by frictional engagement with the antenna at several locations even when the antenna shaft extends downwardly.

Bodies 12 can be placed on and taken off easily from the antenna shafts 16. They are highly visible and prevent poking of the eyes by the antenna shafts 16 regardless of the angular positions of the latter.

After bodies 12 are on respective shafts 16, they will protect against injury to the eyes or other facial parts regardless of the orientation of shafts 16. Moreover, enhancers 13 in respective bodies 12 will improve the television signal reception of shafts 16.

To improve the connection between body 12 and outer end 20 of antenna shaft 16, a cylindrical fastener 24 of the type shown in FIGS. 3*a*–3*c* can be used. For this purpose, body 12 has a cylindrical passage 26 formed therein to receive fastener 24 when the latter is mounted on outer end 20 as shown in FIG. 5. The break in the split-ring enhancer 13 (FIG. 4) is large enough to accommodate passage 26.

Fastener 24 is tubular and formed of a suiable yieldable material, such as rubber. It has two peaked parts 28 at one end, the parts being formed by cutting a V-shaped notch 30 in the end of the fastener. The fastener is slit along a line 32 at one side throughout its entire length and only partially slit along a line 34 on the side diametrically opposed to line 32 as shown in FIGS. 3*b* and 3*c*. The long slit allows the fastener to e placed on outer end 20 and both slit lines 32 and 34 allow peaked parts 28 to be urged laterally and outwardly in opposite directions in a manner to be described.

In use, fastener 24 is placed on outer end 20 near button-like projection 22. Then, body 12 is moved so that fastener 24 is inserted in passage 26 as shown in FIG. 6. Then, body 12 and fastener 24 are moved outwardly of antenna shaft 16 until button-like projection 22 engages peaked parts 28 and forces them laterally as shown in FIG. 7. When this occurs, peaked parts 28 effectively project into body 12 and provide a frictional coupling between the latter and outer end 20 of antenna shaft 16. Moreover, the outer surface of the remainder of fastener 24 is effectively in frictional engagement with body 12 to thereby improve the coupling between the body and the antenna shaft. This outer surface of the fastener can be stippled or roughened to increase the frictional engagement with body 12. This coupling can be removed by forcing projection 22 in the opposite direction to permit removal of body 12 from the antenna shaft, if desired.

FIG. 8 shows another embodiment of a cylindrical fastener, the latter being denoted by the numeral 36. It is also made of a yieldable material, such as rubber, and is tubular. It also has a long slit 38 extending throughout the length of the fastener and a short slit 40 extending only about half way along the length of the fastener. A concave recess 42 is formed by countersinking one end of fastener 36 in any suitable manner, such as by a reaming tool. This recess forms two semi-circular end parts 43 which serve the same purpose as parts 28 of fastener 24. Fastener 36 is used in the same way as fastener 24 and is substantially identical to it except in the way in which the end is shaped.

FIG. 9 shows a fastener 44 similar to fastener 36 except for the use of a flange 46 at the normally outermost end of the fastener. Fastener 44 is usable with body 12 when the latter has a passage 48 of the type shown in FIG. 10. FIGS. 11 and 12 show the way in which the fastener on outer end 20 is inserted into passage 48 and then shifted so that projection 22 causes the two end parts 43 to expand and to project into body 12 as shown in FIG. 12. Flange 46 serves to anchor fastener 44 in place against relative movement once it is inserted into passage 48, the latter having a recess 48*a* at the outer end thereof to accommodate flange 46. The use of flange 46 and recess 48*a* assures that fastener 44 will be inserted only to a desired depth and no further.

FIG. 13 shows a fastener in the form of a small ball 50 on the outer end 20 of antenna shaft 16. Ball 50 can be of styrofoam, polyurethane or rubber or other suitable material which can be stretched to allow insertion of projection 22 into the ball. Also, the ball can be of metal to define a signal enhancer for the purpose mentioned above.

Body 12 has a passage to accommodate ball 50. The inner part of this passage, denoted by the numeral 52 is spherical and is adapted to complementally receive ball 50. The outer end of the passage, denoted by the numeral 54, is narrow and only large enough to accommodate outer end 20. However, the material of body 12 is yieldable so that passage 54 can be enlarged to permit insertion of ball 50 into inner part 52. FIG. 14 shows an enhancer 13 with a partially spherical crosspiece 15 to partially receive and support ball 50 when it is inserted into the inner part 52. FIG. 15 shows the ball fully inserted into inner part 52.

FIG. 16 shows another shape for the protector-receptor. To this end, the protector-receptor 12*a* in FIG. 16 is cylindrical in shape to present a pair of end faces 60 and a cylindrical side 62. The antenna shaft can extend into either face 60 or into side 62, whichever is desired. Body 12*a* can have passages of any of the types mentioned above to accommodate the antenna shaft for this purpose. For purposes of illustration only, FIG. 16 shows the antenna shaft extending into one face 60 thereof.

Other shapes of the protector-receptor can be used, if desired. For instance, the protector-receptor can be a polyhedron with a multiple number of facets. It can be animated, such as with simulations of a household pet or the like, to serve as both an amusing and functional protector-receptor.

I claim:

1. An eye protector for the antenna shaft of a television set comprising: a body of resilient, foam plastic material, the body having a passage extending into the same from the outer periphery thereof, the passage having a fastener extending thereinto, the fastener adapted to be mounted on the antenna shaft and provided with an expandable end movable laterally and into the body for frictional engagement therewith, the fastener being tubular and having a first slit extending along the length of the fastener and a second slit extending only partially along the length of the fastener, there being recess means at one end to define a pair of separable parts, the parts being separated when engaged by a projection on the outer end of the antenna shaft as the fastener moves along and outwardly of the antenna shaft and when it is disposed within the passage of said body.

* * * * *